US011659876B2

(12) United States Patent
Stoppenhagen

(10) Patent No.: US 11,659,876 B2
(45) Date of Patent: May 30, 2023

(54) CROSSBOW MITT

(71) Applicant: Randall T. Stoppenhagen, Nampa, ID (US)

(72) Inventor: Randall T. Stoppenhagen, Nampa, ID (US)

( * ) Notice: Subject to any disclaimer, the term of this patent is extended or adjusted under 35 U.S.C. 154(b) by 0 days.

(21) Appl. No.: 16/736,780

(22) Filed: Jan. 7, 2020

(65) Prior Publication Data

US 2020/0221797 A1 Jul. 16, 2020

Related U.S. Application Data

(60) Provisional application No. 62/842,338, filed on May 2, 2019, provisional application No. 62/789,429, filed on Jan. 7, 2019.

(51) Int. Cl.
*A41D 19/01* (2006.01)
*F41B 5/14* (2006.01)
*F41A 35/00* (2006.01)

(52) U.S. Cl.
CPC ..... *A41D 19/01* (2013.01); *F41A 35/00* (2013.01); *F41B 5/148* (2013.01)

(58) Field of Classification Search
CPC ..... A41D 19/01; A41D 27/10; A41D 13/08; A41D 13/081; A41D 13/085; F41A 35/02; F41A 35/00; A63B 2244/04; F41B 5/14
USPC ..... 2/160, 161.1, 161.5
See application file for complete search history.

(56) References Cited

U.S. PATENT DOCUMENTS 3,167,875 A 2/1965 Winner
3,742,635 A 7/1973 Hutto
4,543,671 A * 10/1985 Monk ..... A41D 19/01535 2/158
4,754,498 A * 7/1988 Stinemates ..... F41A 35/02 2/158
4,805,338 A * 2/1989 Schublom ..... A01K 87/085 2/161.8
4,947,573 A 8/1990 Bischoff
5,265,365 A 11/1993 Finn
5,678,248 A * 10/1997 Lengyel ..... A41D 19/01 2/158
5,678,249 A 10/1997 Smith
5,699,632 A * 12/1997 Stout ..... A01K 87/085 2/158
6,119,388 A * 9/2000 Jones ..... F41A 35/02 42/96
6,256,922 B1 7/2001 Jones
7,559,168 B2 7/2009 Wisecup
(Continued)

*Primary Examiner* — Jameson D Collier
*Assistant Examiner* — Matthew R Marchewka
(74) *Attorney, Agent, or Firm* — Scott D. Swanson; Shaver & Swanson, LLP

(57) ABSTRACT

A hand warmer for use with a long gun or crossbow having a sleeve of fabric configured to circumvolve a user's forearm. A user inserts his or her forearm at the second end of the tube. The first end of the tube is configured to attach to a long gun or crossbow. The first end can be configured with a section of fabric that fits between the barrel and pump action of a pump action shotgun. The first end can be configured to attach to the forend of a crossbow such as by hook and loop fastener, snaps, or zippers. The first end can be configured for positioning over the barrel of a rifle such that the first end is below a line of sight through a scope attached to the rifle.

8 Claims, 6 Drawing Sheets

(56) References Cited

U.S. PATENT DOCUMENTS

| | | | | |
|---|---|---|---|---|
| 8,375,617 | B2 * | 2/2013 | Brensinger | F41A 35/02 206/317 |
| 8,776,267 | B2 * | 7/2014 | Narboni-Campora | A41D 13/085 2/158 |
| 9,506,713 | B2 | 11/2016 | Frazier | |
| 2015/0173437 | A1 * | 6/2015 | Thompson | A41D 19/01 2/158 |
| 2015/0345896 | A1 | 12/2015 | Michal | |
| 2015/0362280 | A1 | 12/2015 | Dale | |
| 2017/0234643 | A1 * | 8/2017 | Stoppenhagen | F41B 5/14 124/88 |

* cited by examiner

CROSSBOW MITT

PRIORITY/CROSS-REFERENCE TO RELATED APPLICATIONS

This application claims the benefit of U.S. Provisional Application No. 62/789,429, filed Jan. 7, 2019, and U.S. Provisional Application No. 62/842,338, filed May 2, 2019, the disclosures of each of which is incorporated by reference.

TECHNICAL FIELD

The disclosure generally relates to the field of hunting and shooting accessories and more particularly to a hunting and shooting accessories or clothing that keep a user's hands warm while grasping the forend of a gun or crossbow and to keep a user's trigger hand or archery release hand warm.

BACKGROUND

Long guns, such as shotguns and rifles are popular for shooting and use in hunting. Hunting seasons and shooting in northern climates often occur during cold periods of the year. Typically a user seats a butt of the long gun against the user's trigger arm shoulder and grasps a forend of the gun with the user's opposite hand. The user's trigger hand pulls a trigger to fire the gun.

Crossbows have a similar construct as long guns, but instead utilize a bow string stretched between two limbs that are attached to or integral with a frame. The frame has a similar shape to that of a long gun stock and forearm. A user seats a butt of the crossbow against the user's trigger arm shoulder and grasps a forend (often called the handle) of the crossbow. The user's trigger hand pulls a trigger to release the shooting string and propel the bolt forward.

Cold weather can cause the user's hands to get cold, which can negatively impact the user's shooting capability or even deter a user from hunting or shooting in the cold. Cold hands can negatively affect a user's ability to load his or her gun or crossbow, to aim the gun or crossbow, and/or to pull the trigger in a motion that allows for the most accurate aiming of the gun or crossbow. Cold hands can be a problem particularly when the user is holding the gun or crossbow for long periods of time, such as when sitting in a blind or tree stand. For example, a crossbow user during a late whitetail deer hunt, which often occurs in northern states during November and December, may sit or stand in a tree stand with the gun or crossbow at the ready for an hour or longer. During the day, the user's hand may get cold from grasping the gun or crossbow. The user can remove his or her hand from the forend of the gun or cross to warm it up, but this puts a user at a position in which if a deer appears, the user will not be ready to shoot the crossbow.

One option for a user to keep his or her hands warm is to use a standard cold weather glove to keep his or her hand warm. However, this may provide inadequate insulation and thus not keep the user's hand warm. Use of a glove also prevents the user from having direct hand to gun or crossbow contact. Some users believe direct hand to gun or crossbow contact leads to improved accuracy when shooting the gun or crossbow.

Accordingly, what is needed is a device that will keep a gun or crossbow user's hand warm while grasping the gun or crossbow, allow the gun or crossbow user to shoot the gun or crossbow without interfering with the mechanical aspects of the gun or crossbow, and provide an easy-to-use interface such that a user can easily remove and re-insert the user's hand into the device without having to remove the device from the gun or crossbow.

SUMMARY

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

A hand warmer is disclosed for use in shooting a long gun or crossbow. The hand warmer has a sleeve that is configured to circumvolve at least a portion of user's forearm. The sleeve has a first end and a second end. The first end is configured to attach to a forend of a gun or crossbow. The second end is configured for insertion of a user's hand. The sleeve is configured to attach to the forend of a gun or crossbow such as to not interfere with a user's natural or standard grasping of the gun or crossbow. This is thought to be at an angle of between approximately fifteen and forty five degrees to an axis defined by the length of a long gun or crossbow frame. The first end of the sleeve is configured to connect or attach to the forend of a long gun or bow. The first end can be open and configured to attach by a fastener, such as hook and loop fasteners, snap buttons, a zipper or other attachment. Alternatively the first end can be configured with foam or other fabric and configured to be positioned over the barrel of a long gun. Alternatively the foam or fabric can be configured to be positioned between the forend of a pump action shotgun such that the sleeve travels with the moving forend of the pump action shotgun when a user "pumps" the shotgun to clear the chamber of the shotgun and/or load the chamber of the shotgun.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature

DETAILED DESCRIPTION OF THE EXEMPLARY EMBODIMENTS

Figure 1:
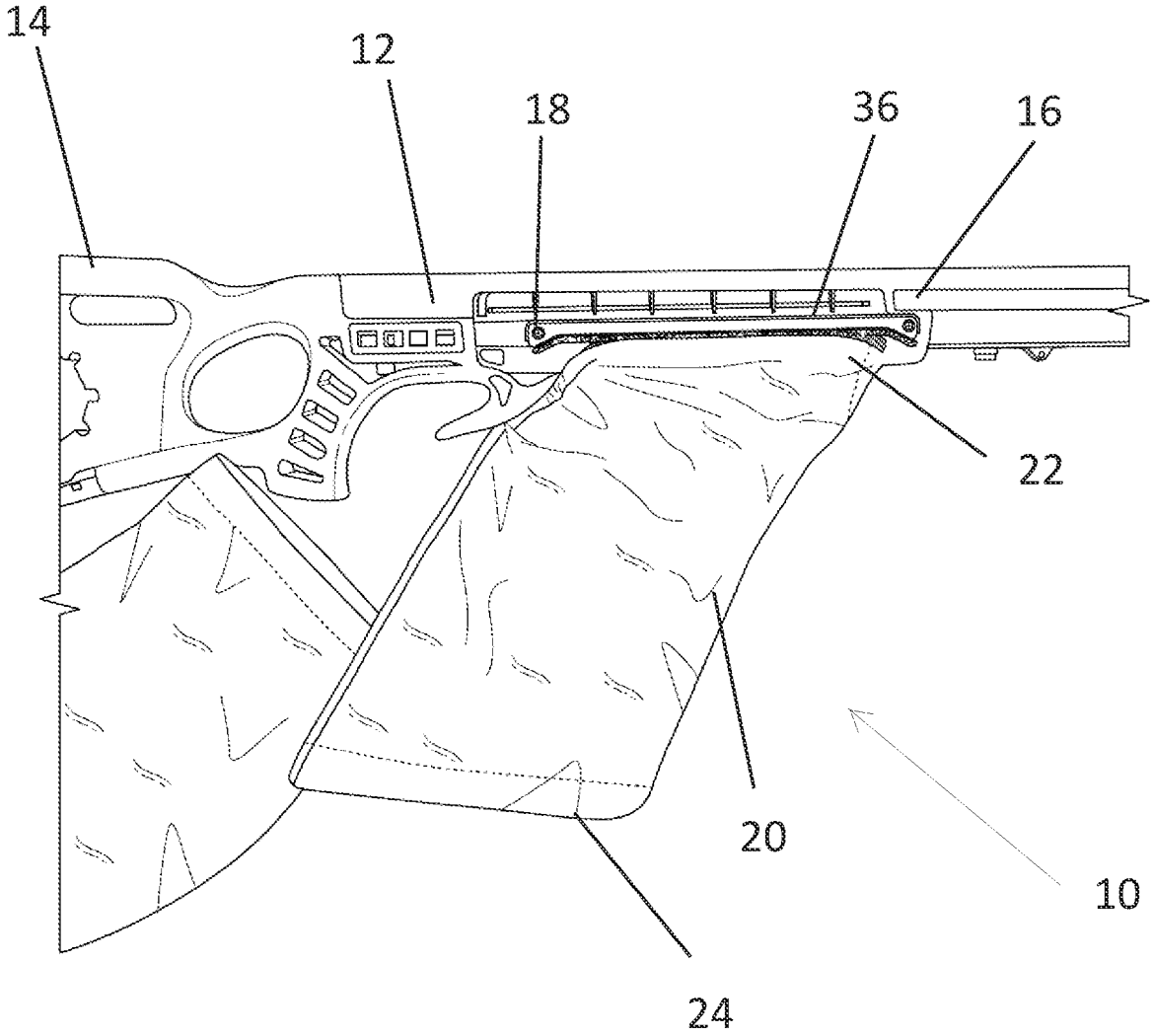
FIG. 1 illustrates a side view of a third embodiment of a shooting mitt positioned on a frame of a crossbow frame.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

FIGS. 1 through 6 depict a further embodiment of the invention 10 attached to a crossbow frame 12. The crossbow frame has a stock 14 and a forend 16. The depicted embodiment of the invention comprises a sleeve 20 that has a first end 22 and a second end 24. The sleeve is configured to be attached to the forend 16 of the crossbow at a first end 22 of the sleeve. In a preferred embodiment the sleeve 20 is attached at the first end 22 of the sleeve to the forend 16 of the crossbow by hook and loop fasteners positioned along the forend of the crossbow and the first end of the sleeve. The forend hook and loop fasteners are attached to a first side and a second side of the forend of the crossbow base. In a preferred embodiment, the hook and loop fastener of the crossbow forend are configured to be attached to a finger guard 18 that is incorporated onto at least some crossbow models. The finger guard 18 generally is made of a flange attached to a first side 36 and a second side 38 of the forend. The flange can either be screwed, bolted, or integral with the forend or foregrip. For the purposes of this document the finger guard is included in the definition of the forend of the crossbow. A variety of attachment mechanisms can be utilized to attach the first end of the sleeve to the crossbow. This includes, for example, an elastic bungee cord system, a c-clip attached to each side of the finger protector, snap buttons on the first end of the sleeve and on the forend of the crossbow, or other attachment mechanism.

Figure 2:
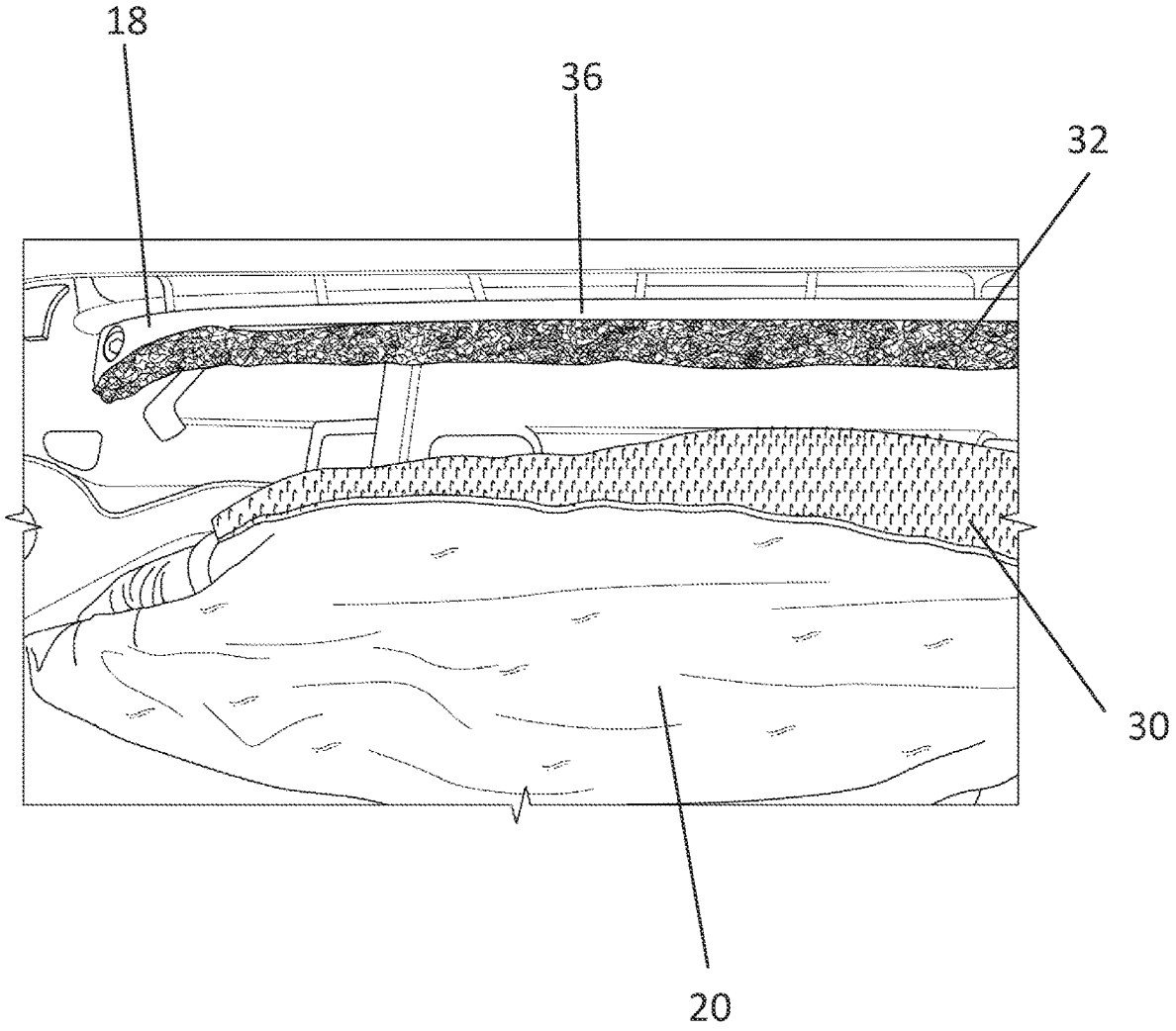
FIG. 2 illustrates a close up view of fasteners attached to a first end of a third embodiment of a shooting mitt and corresponding fasteners attached to a forend of a crossbow frame.

FIG. 2 is a magnified view of a hook and loop fastener 30 of the sleeve, and corresponding hook and loop fastener 32 attached to the finger guard 18 of the forend of the crossbow.

Figure 3:
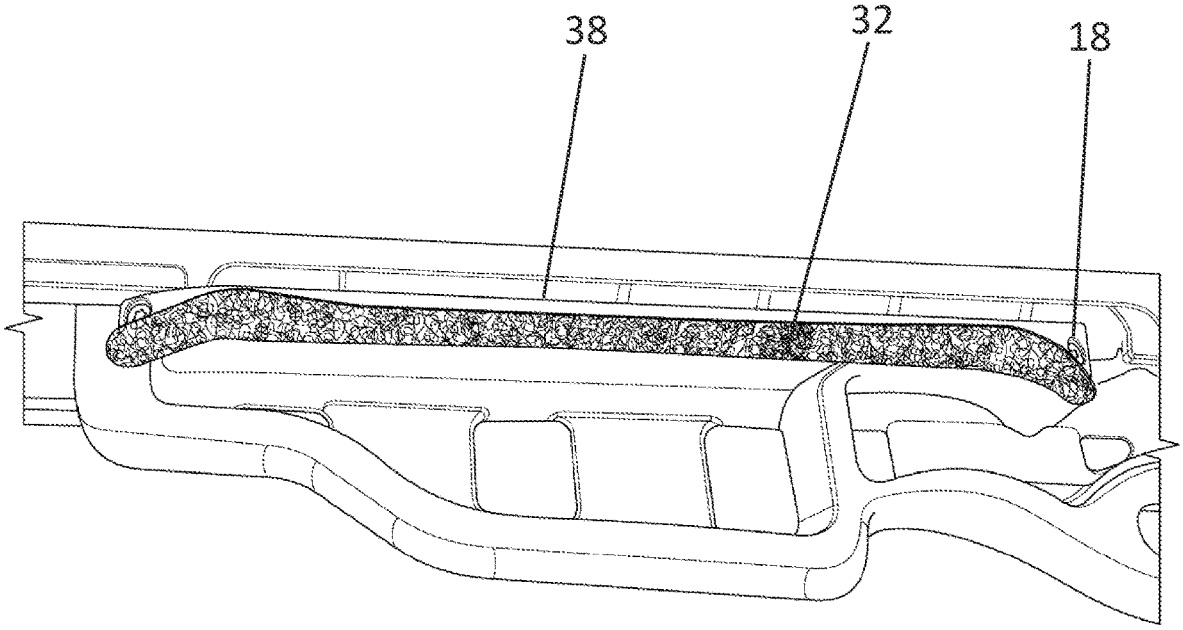
FIG. 3 illustrates a bottom perspective view of fasteners attached to a forend of a crossbow frame.

FIG. 3 illustrates a bottom perspective view of a crossbow base of a second side 38 of a crossbow frame 12 having a finger guard flange 18 having a hook and loop fastener 30, 32 attached to the finger guard. The fastener attached to the finger guard flange is called the crossbow fastener. The fastener on the sleeve configured for mating engagement with the finger guard flange is called the sleeve fastener.

Figure 4:
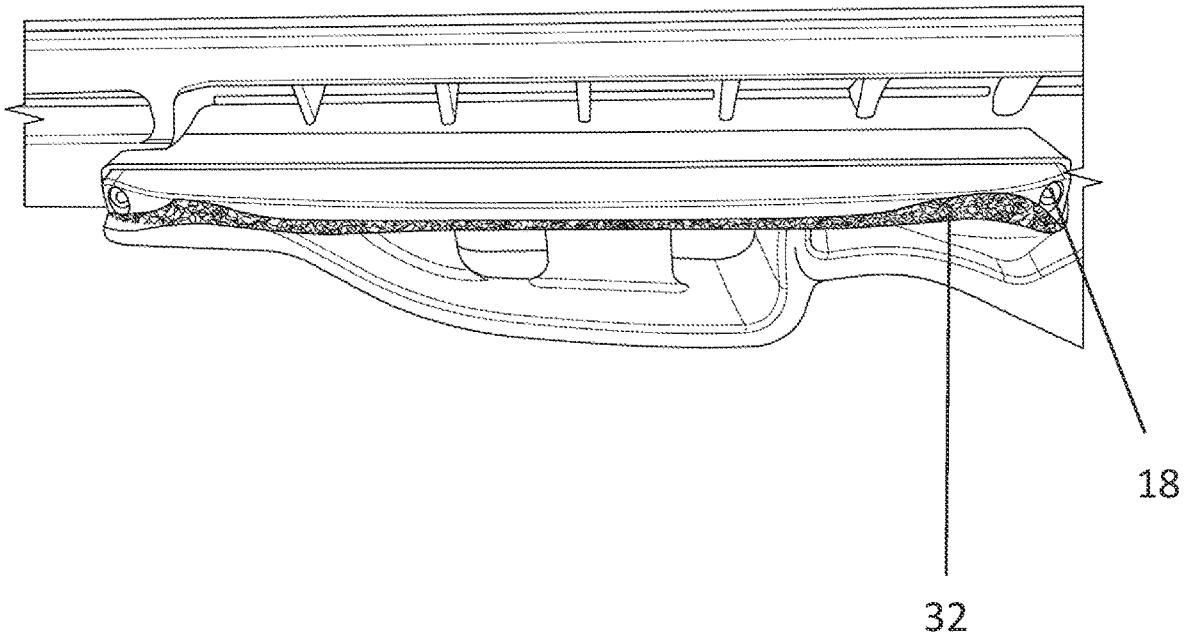
FIG. 4 illustrates a top perspective view of fasteners attached to a forend of a crossbow frame.

FIG. 4 is a top perspective view of a hook and loop fastener attached to the finger guard flange of the second side. FIG. 4 illustrates that the top side of the finger guard flange is free of hook and loop fastener attachment in a preferred embodiment. FIG. 4 illustrates a top perspective view of the second side 38 of a crossbow base having a hook and loop fastener attached.

Figure 5:
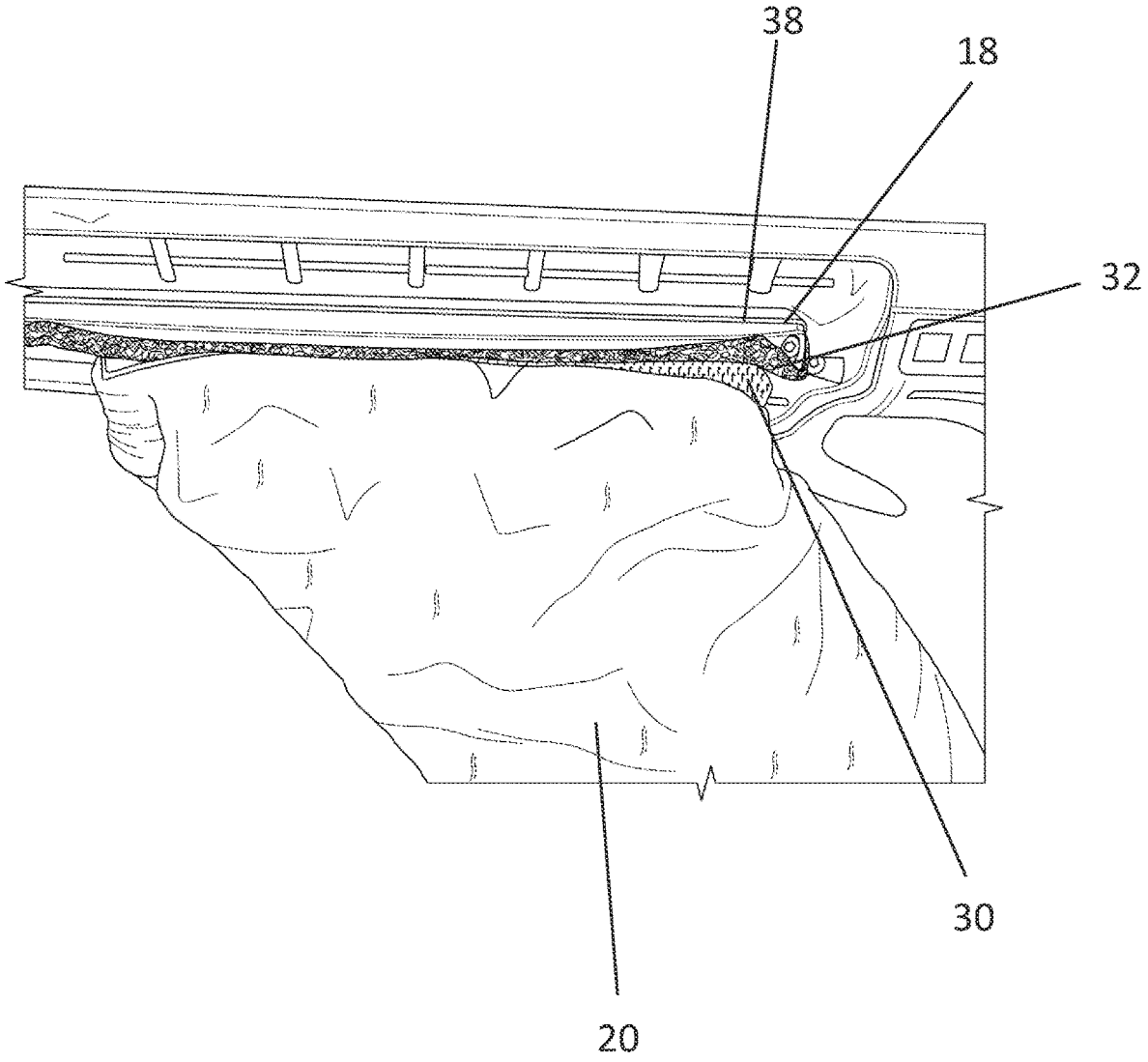
FIG. 5 illustrates a side perspective view of a shooting mitt attached to a forend of a crossbow frame.
Figure 6:
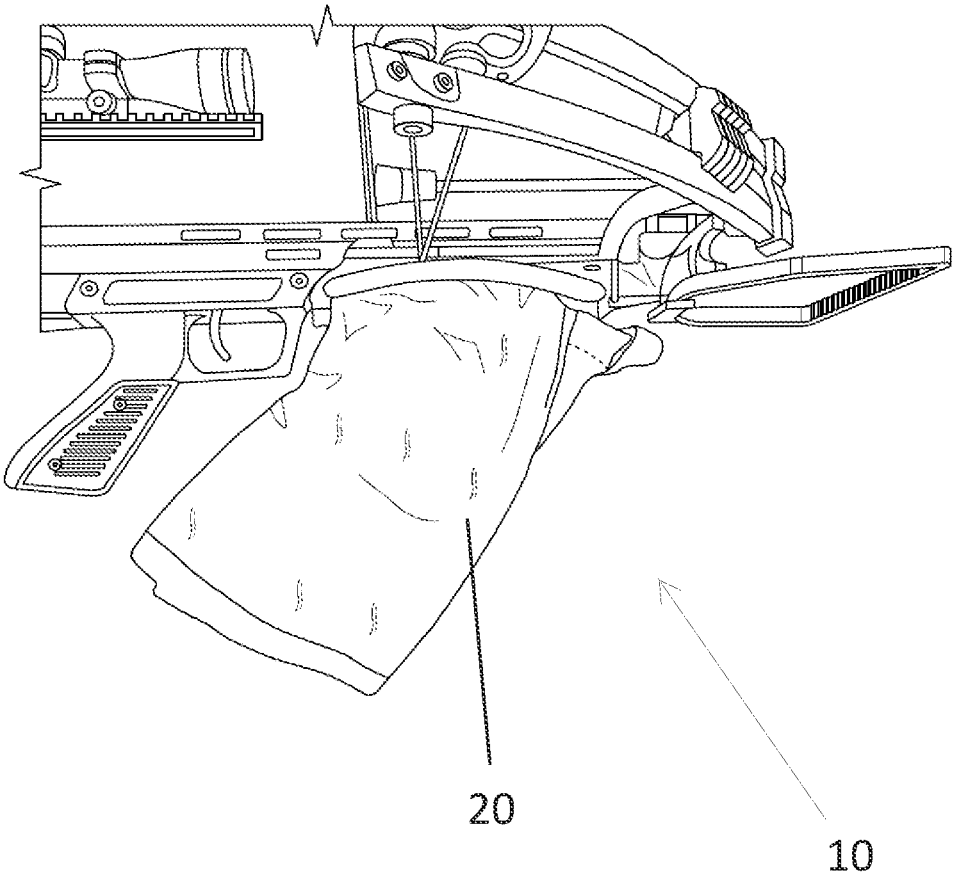
FIG. 6 illustrates an expanded perspective view of a shooting mitt attached to a foreend of a crossbow frame.

FIG. 5 illustrates a second side 38 of crossbow frame 12, having a sleeve 20 attached via hook and loop fastener opposing sections 30, 32 attached to the hand protecting flange of the finger guard 18 and the sleeve 20. The sleeve serves to allow a user's forend or foregrip hand to grasp the forend or foregrip by being placed through the sleeve. The sleeve allows a user to grasp the forend of the crossbow and to keep the user's hand warm. This will allow the user to use the crossbow without additional gloves or mittens while still keeping the user's hand warm. FIG. 6 illustrates an expanded perspective view of the sleeve 20 as attached to a crossbow.

Preferably each embodiment discussed herein includes an internal pocket configured for the acceptance of a chemical handwarmer such as those commonly available on the retail market.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

We claim:

1. A crossbow and sleeve combination, the combination comprising:

the crossbow comprising a crossbow forend with a top side being proximate to a bowstring of the crossbow and a first side and a second side extending from said top side, the first side and the second side being on opposing sides of said crossbow forend;

the sleeve comprising a first end and a second end, wherein said sleeve defines a passageway extending between an opening of said first end and an opening of said second end, the passageway defining a tube shape;

wherein said first end of said sleeve is attached to said crossbow forend on said opposing sides of said crossbow forend, said sleeve extending away from said crossbow forend to said second end;

wherein said second end of said sleeve being configured for insertion of a user's hand through said passageway to grip said crossbow forend such that said sleeve circumvolves the user's forearm when the user is grasping said crossbow forend.

2. The crossbow and sleeve combination of claim 1, wherein said first end of said sleeve is attached to said first side and said second side of the crossbow forend via hook and loop fasteners.

3. The crossbow and sleeve combination of claim 1, wherein said passageway extending between said first end and said second end is configured to be positioned at an angle between fifteen and forty five degrees to an axis of the crossbow forend when said first end of said sleeve is attached to the crossbow forend.

4. The crossbow and sleeve combination of claim 1, wherein said sleeve comprises two sections of fasteners positioned on opposing sides of said opening at said first end of said sleeve and configured to attach to said crossbow forend.

5. The crossbow and sleeve combination of claim 4, wherein said two sections of fasteners are each configured for releasable mating engagement with said forend of said crossbow.

6. The crossbow and sleeve combination of claim 5, wherein a first section of the two sections of fasteners comprises a loop, wherein a second section of the two sections of fasteners comprises a hook, and wherein the two sections of fasteners comprise hook and loop fasteners.

7. The crossbow and sleeve combination of claim 4, wherein said two sections of fasteners positioned on the opposing sides of said opening at said first end of said sleeve are each configured to attach to corresponding crossbow fasteners attached to said forend of said crossbow.

8. A combination of a sleeve and a crossbow, the combination comprising:

the sleeve being attached to the crossbow;

the crossbow comprising a crossbow forend with a top side being proximate to a bowstring of the crossbow and a first side and a second side extending from said top side, the first side and the second side being on opposing sides of said crossbow forend;

the sleeve comprising a first end and a second end, wherein said sleeve defines a passageway extending between an opening of said first end and an opening of said second end, the passageway defining a tube shape, wherein said first end of said sleeve is attached to said crossbow forend on said opposing sides of said crossbow forend and extending away from said crossbow forend and away from said bowstring, wherein said second end of said sleeve being configured for insertion of a user's hand through said passageway to grip said crossbow forend such that said sleeve circumvolves the user's forearm when the user is grasping said crossbow forend.

* * * * *